United States Patent [19]

Heggenstaller

[11] Patent Number: 4,559,195

[45] Date of Patent: Dec. 17, 1985

[54] PRESSED-MATERIAL PALLET CLEAT AND METHOD AND MOLD FOR MAKING SAME

[76] Inventor: Anton Heggenstaller, Mühlenstr. 9, 8891 Unternbernbach, Fed. Rep. of Germany

[21] Appl. No.: 461,604

[22] Filed: Jan. 27, 1983

[30] Foreign Application Priority Data

| | | | |
|---|---|---|---|
| Jan. 29, 1982 | [DE] | Fed. Rep. of Germany | 3203032 |
| Mar. 11, 1982 | [DE] | Fed. Rep. of Germany | 3208875 |
| Jun. 11, 1982 | [DE] | Fed. Rep. of Germany | 3222122 |
| Jul. 20, 1982 | [DE] | Fed. Rep. of Germany | 3227074 |

[51] Int. Cl.[4] ..... D04H 1/16

[52] U.S. Cl. ..... 264/120; 248/188.2; 248/346; 264/113; 264/122; 264/128; 264/294

[58] Field of Search ..... 264/120, 122, 113, 128, 264/294; 248/346, 188.2

[56] References Cited

U.S. PATENT DOCUMENTS

| | | | |
|---|---|---|---|
| 2,888,715 | 6/1959 | Frank | 264/120 |
| 3,104,085 | 9/1963 | Skladany | 108/51.1 |
| 3,342,146 | 9/1967 | Lessheim | 108/53.3 |
| 3,449,482 | 6/1969 | Mitchell et al. | 264/120 |
| 3,632,276 | 1/1972 | Munk | 425/415 |
| 3,809,736 | 5/1974 | Munk | 264/120 |
| 3,933,968 | 1/1976 | Sorbier | 264/120 |
| 4,127,636 | 11/1978 | Flanders | 264/113 |
| 4,213,928 | 7/1980 | Casselbrant | 264/120 |
| 4,273,581 | 6/1981 | Inoue | 264/120 |
| 4,303,019 | 12/1981 | Haataja et al. | 108/51.1 |
| 4,385,564 | 5/1983 | Heggenstaller | 264/151 |

FOREIGN PATENT DOCUMENTS

| | | | |
|---|---|---|---|
| 0050164 | 10/1980 | European Pat. Off. . | |
| 2112558 | 10/1971 | Fed. Rep. of Germany . | |
| 2407642 | 8/1974 | Fed. Rep. of Germany . | |
| 2306507 | 9/1974 | Fed. Rep. of Germany | 264/120 |
| 2508493 | 9/1976 | Fed. Rep. of Germany . | |
| 2823053 | 11/1979 | Fed. Rep. of Germany . | |
| 3035701 | 5/1982 | Fed. Rep. of Germany . | |
| 3227074 | 7/1984 | Fed. Rep. of Germany . | |
| 2301441 | 9/1976 | France . | |
| 1347745 | 2/1974 | United Kingdom . | |
| 2022509 | 12/1979 | United Kingdom . | |

*Primary Examiner*—Jeffery Thurlow
*Assistant Examiner*—Patrick Dailey
*Attorney, Agent, or Firm*—Karl F. Ross; Herbert Dubno

[57] ABSTRACT

A structural member is press-molded from a mass of elongated cellulosic particles and a binder. The mass is randomly filled, that is with the particles not extending parallel to one another, into a horizontally elongated compartment defined between a pair of horizontally confronting side walls having central portions, a top wall, and a bottom wall confronting the top wall and extending generally parallel to the top and side walls. The top and bottom walls are then displaced vertically toward each other into predetermined intermediate positions without substantial movement of the side walls so as to vertically pre-compress the mass in the compartment. Thus the particles engaging the top and bottom walls are generally parallelized therewith. At least the central portions of the side walls are then displaced horizontally toward each other between the top and bottom walls without substantial movement of the top and bottom walls from their intermediate positions so as to horizontally pre-compress the vertically compressed mass in the compartment. These steps may also be repeated in the same sequence. Finally the top and bottom walls are displaced vertically toward each other into terminal positions to further vertically compress the mass in the compartment to the final dimensions of the member without substantial movement of the side walls. The mass is then subjected to heat and cured and hardened between the walls without substantial movement of same.

10 Claims, 22 Drawing Figures

Fig 1
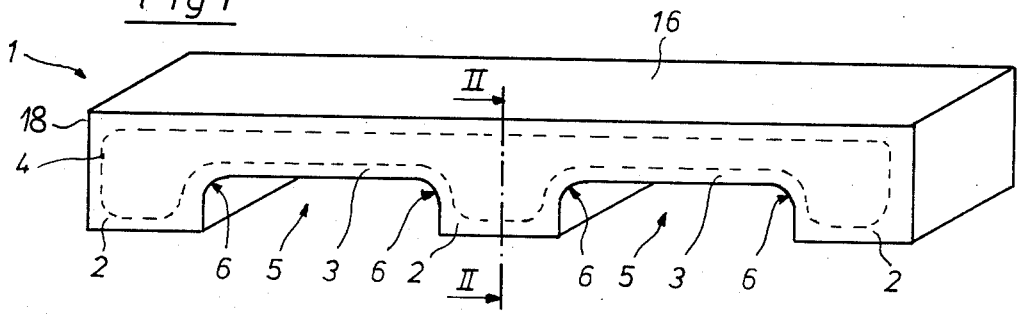
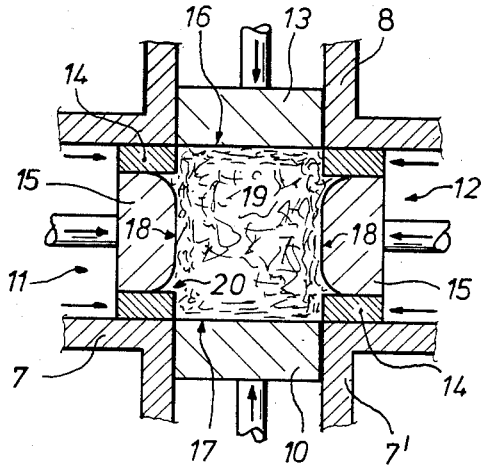
Fig 3
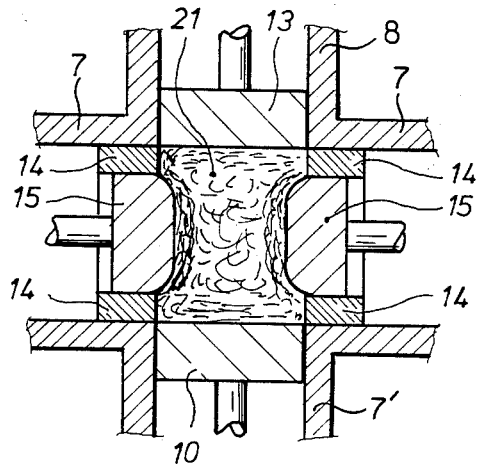
Fig 4
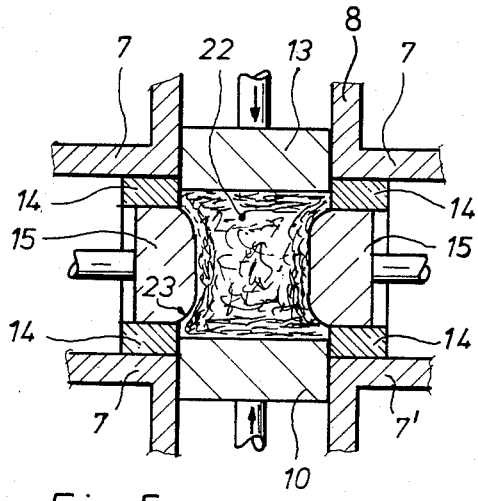
Fig 5
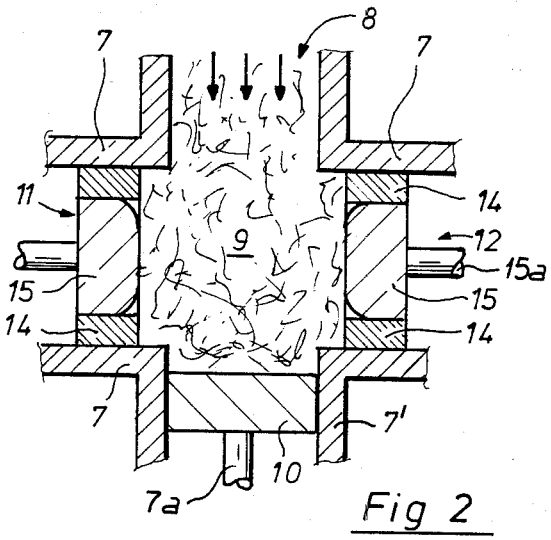
Fig 2

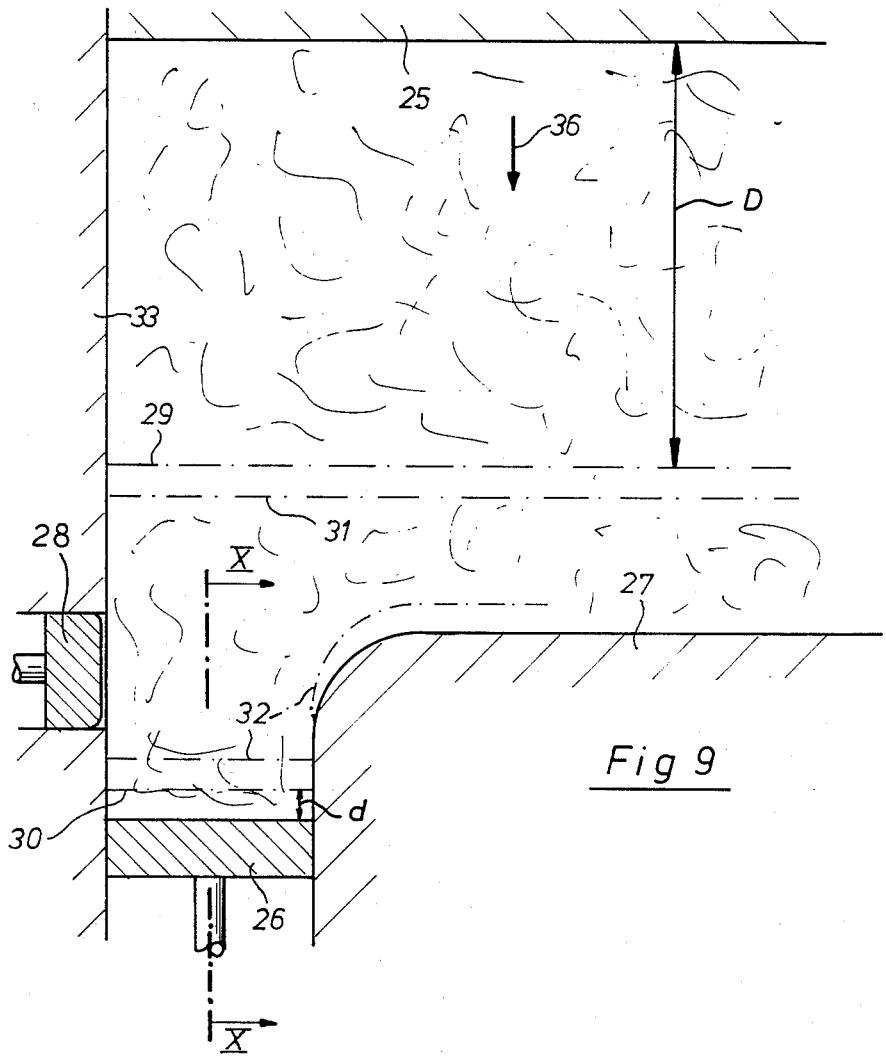
Fig 9
Fig 10
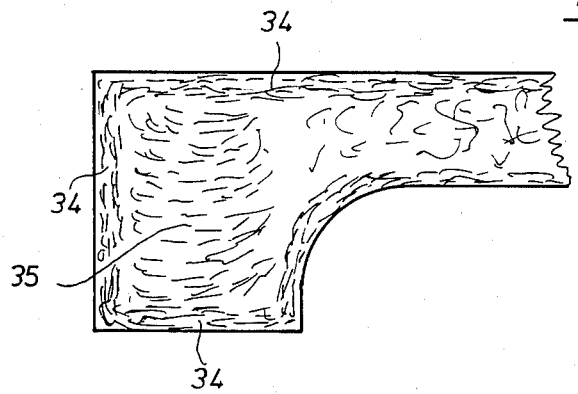

PRESSED-MATERIAL PALLET CLEAT AND METHOD AND MOLD FOR MAKING SAME

FIELD OF THE INVENTION

The present invention relates to a structural member. More particularly this invention concerns a structural member such as a pallet or pallet cleat and a method of and mold for making same.

BACKGROUND OF THE INVENTION

It is known to make a freight pallet, that is a rigid load-supporting structure normally having a planar top formed by a single plate or a plurality of coplanar planks and feet formed normally on a plurality of parallel cleats secured underneath the top. Such a pallet is described in French Pat. No. 2,301,441.

In my copending patent application Ser. No. 219,859 filed 23 Dec. 1980 I disclose a method of making a pallet wherein a mass of coarse and fine particles and a binder is filled into an upwardly open elongated mold of generally regular cross section in such a manner that the fine particles are concentrated in the lower portion of the mass and the coarse particles are concentrated in the upper portion of the mass. The mass of particles is then compressed downward in the mold to a relatively great extent at several longitudinally spaced locations and to a lesser extent therebetween to form upwardly projecting bumps between the locations. The thus compressed mass is then cured into a stiffening rib or cleat. At least one board is secured to a plurality of such ribs or cleats arranged parallel to one another.

The pallet according to my earlier invention therefore has at least one board, and a plurality of like elongated stiffening ribs having flat upper sides secured to the board and lower sides formed with downwardly projecting and longitudinally spaced bumps. These ribs or cleats are each formed of a compressed mass of bound-together coarse and fine particles with the coarse particles concentrated toward the respective upper side and the fine particles concentrated toward the respective lower side and bumps. The masses are each compressed more between the bumps than at the bumps.

It is also known, as for example from German patent document 2,508,493 and from U.S. Pat. Nos. 3,104,085 3,342,146, and 4,303,019, to make the entire pallet as a single integral molded element formed of cellulosic, that is plant-origin, particles and an appropriate thermosetting binder. Such pallets are normally relatively weak, being particularly susceptible to damage from bending. It has been suggested in German patent document 3,035,701 to compress the structural members constituting the cleats more between the feet than at them to increase their strength and resistance to breaking in this region. Although an increase in strength is obtained in this manner the resultant pallet is still considerably weaker than a standard solid-oak pallet.

OBJECTS OF THE INVENTION

It is therefore an object of the present invention to provide an improved pressed-material structural member usable as a pallet or part of same.

Another object is the provision of such a pressed-material structural member usable as a pallet or part of same which overcomes the above-given disadvantages.

A further object is the provision of an improved method and mold for making the structural member according to the invention.

SUMMARY OF THE INVENTION

These objects are attained according to the instant invention in a method of making an elongated structural member from elongated cellulosic particles and a binder wherein a mass of the particles and binder is randomly filled, that is with the particles not extending parallel to one another although a stratified filling according to my earlier invention may be used, into a horizontally elongated compartment defined between a pair of elongated and horizontally confronting side walls having central portions, an elongated top wall, and an elongated bottom wall confronting the top wall and extending generally parallel to the top and side walls. The top and bottom walls are then displaced vertically toward each other into predetermined intermediate positions without substantial movement of the side walls so as to vertically compress the mass in the compartment. Thus the particles engaging the top and bottom walls are aligned generally therewith. At least the central portions of the side walls are then displaced horizontally toward each other between the top and bottom walls without substantial movement of the top and bottom walls from their intermediate positions so as to horizontally compress the vertically compressed mass in the compartment. Finally the top and bottom walls are displaced vertically toward each other into terminal positions to further vertically compress the mass in the compartment without substantial movement of the side walls. The mass is then cured and hardened between the walls without substantial movement of same.

The structural member made according to this method will have its particles, normally elongated wood chips, immediately adjacent its top and bottom surfaces aligned generally parallel thereto, much more so than in the prior-art assemblies wherein the mold is simply closed in one stage on the mass of particles. Vertically compressing the mass in this manner aligns the particles against the critical top and bottom walls parallel thereto. The result is in effect a parallel-particle skin on the structural member which increases its strength, in particular its resistance to bending, enormously.

According to this invention the top and bottom walls are moved toward each other one after the other, with the top wall moving down before the bottom wall moves up. In addition the top wall is displaced downward through a distance many times greater than the distance through which the bottom wall is displaced upward, the difference being a factor of at least ten. In this manner excellent orientation of the particles of the side surfaces in the critical upper region of the element is ensured.

Such a procedure also makes the interior elongated particles of the cleat or structural member produced in this manner lie mainly on lines concave toward the top surface and in planes transverse to the cleat. In use the cleat is overturned so that the particles form arches that add enormously to the strength of the unit.

More particularly when the top wall is displaced downward through a long vertical step and the bottom wall is then displaced upward through a short vertical step without substantial movement of the top wall, it is possible according to this invention to simultaneously vertically displace the top and bottom walls toward each other through respective short vertical steps. In such an arrangement the mass is compressed vertically in the first step so that its volume is reduced by about twice as much as in the second step which in turn is at least twice as much as in the third step. About 65% of the total vertical compression is done in the first step, about 35% in the second step, and about 5% in the third step.

The horizontal compression can also occur stepwise according to this invention, by first displacing the entire side walls horizontally toward each other and then displacing only the central portions of the side walls toward each other. When the top and bottom walls are subsequently advanced they enter between outer portions of the side walls but not between the central portions thereof. This produces an I-section pallet cleat having an elongated body in turn having an elongated top surface formed by the top wall, an elongated bottom surface generally parallel to the top surface, formed by the bottom wall, and formed with at least two downwardly projecting feet, and a pair of generally parallel side surfaces extending between the top and bottom surfaces and over the feet thereof, formed by the side walls, and formed with recesses extending down into the feet and formed by the central portions of the side walls. The side surfaces therefore have outwardly directed annular rims each having an inner periphery defined by the outer edge of the respective recess and an outer periphery that is at the top and bottom surfaces the boundary between same and the respective side surface.

These recesses according to this invention have a depth equal to 10% to 20% of the width of the pallet measured perpendicular to the side surfaces and parallel to the top and bottom surfaces. The particles immediately adjacent the top, bottom, and side surfaces extend generally parallel thereto as described above and it is possible for the cleat to further have an integral lug extending from the side surface and having an upper face coplanar with the top surface. The board or boards forming the top of a pallet incorporating this cleat are secured to the top surfaces and lugs so the pallet is very stable.

It is also possible to mold an entire pallet according to this invention. In this case the recesses are normally formed only in the outer side surfaces of the edge cleats. In addition such recesses can be formed in the bottom surfaces to increase the hardness and strength thereof.

The mold for carrying out the method of this invention has respective top and bottom pistons having faces forming the top and bottom walls and respective side pistons forming the side walls and having respective annular outer parts and central parts surrounded thereby, the central parts forming the central portions of the side walls. The central parts are displaceable toward each other independently of the respective annular outer parts.

In such an arrangement the face of the bottom piston is formed by at least two generally coplanar recessed portions generally parallel to the top wall and at least one generally planar raised portion generally parallel to the top wall and closer to same than the recessed portions. Thus the member made with this mold has two feet formed by the recessed portions. For maximum strength the bottom piston is formed with smoothly curved transition regions between the recessed and raised portions. It is also possible for the raised portions of the bottom piston to be displaceable toward the top piston independently of the recessed portions. Such an arrangement allows for differential pressing between the foot regions and the portions between them.

DESCRIPTION OF THE DRAWING

The above and other features and advantages will become more readily apparent from the following, reference being made to the accompanying drawing in which:

FIG. 1 is a perspective view of a pallet cleat according to this invention;

FIGS. 2–5 are sectional views illustrating the molding of the cleat of FIG. 1;

FIG. 9 is a large-scale view of a detail of FIG. 6;

FIG. 10 is a cross section through a detail of a pallet produced by the system of FIGS. 6–9;

SPECIFIC DESCRIPTION

Figure 6:
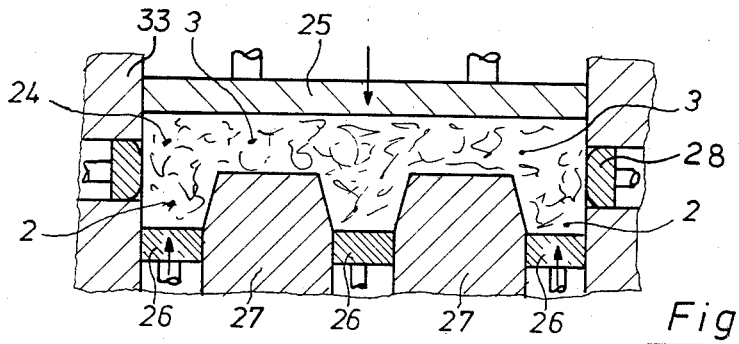
FIG. 6 is a vertical section through a mold making a one-piece pallet according to this invention in a first step of operation.

As seen in FIG. 1 a pallet cleat 1 is elongated and has a planar upper face 16 and three downwardly projecting equispaced feet 2 separated by notches 5. These feet 2 join intermediate parts 3 of the cleat 1 at corners 6 that are rounded for strength and to avoid cracking at this region. Longitudinal side surfaces 18 of the cleat 1 are formed with recesses whose edges are indicated at dashed-line 4 of FIG. 1.

FIG. 2 shows a mold for making the cleat 1. This mold has two side guides 7, one top guide 8, and one bottom guide 7' opening at right angles to each other and each extending the full mold length. Respective pistons 11 and 12 are displaceable in the side guides 7, and respective bottom and top pistons 10 and 13 (see FIG. 3) are similarly displaceable in the bottom and top guides 7' and 8. The intersection of these guides 7, 7', and 8 constitutes a press-molding chamber or compartment 9 that to start with is of cruciform section. The two side pistons 11 and 12 are each formed of an annular outer part 14 and a solid inner core part 15 displaceable independently of each other. Respective actuators such as shown in part at 15*a* and 7*a* serve to displace the pistons 10 and 13 and piston parts 14 and 15 independently of one another toward and away from a centerpoint of the compartment 9.

Figure 14:
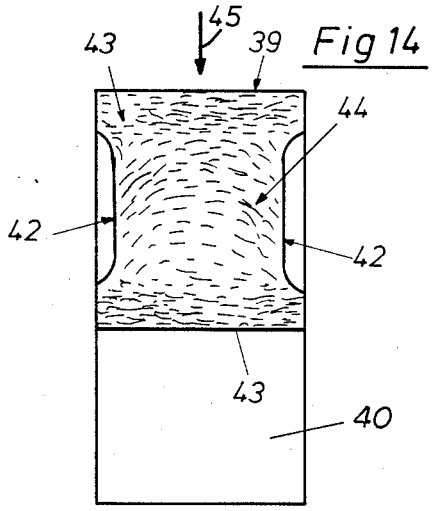
FIGS. 14 and 15 are cross sections taken respectively along lines XIV—XIV and XV—XV of FIG. 13.
Figure 15:
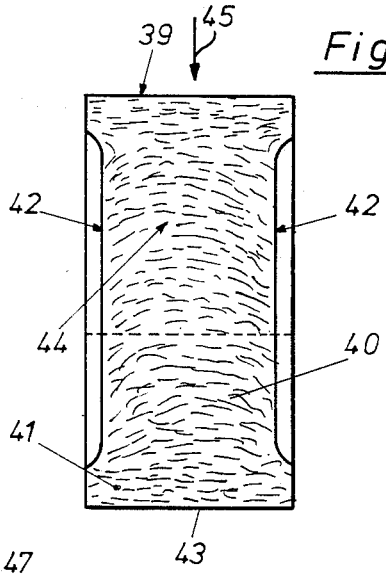

To make the pallet cleat 1 the pistons 10–12 are all retracted as shown in FIG. 2 and the piston 13 is moved wholly out of the upper guide 8. Fibrous material with a binder, which may be of increasingly coarser particle size as described in the above-cited copending patent application, is poured into the compartment 9 to comwardly concave arcs as seen in FIGS. 14 and 15 which are approximately actual size.

Figure 17:
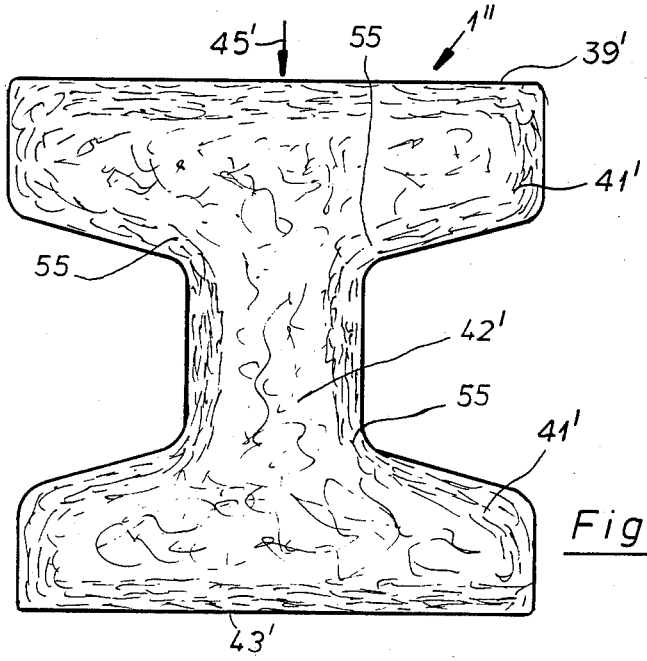
FIG. 17 is a cross section through another structural member according to the invention.

FIG. 17 shows an I-beam structural member 1'' and FIGS. 18–22 show the mold for making it. This cleat 1'' is elongated and of uniform I-section. It has a planar upper face 39' and lower face 43' parallel thereto. In addition the I-beam 1'' has a central web 42' and a pair of flanges 41' as is standard in such a structure. The web 42' is of substantially the same thickness as the flanges 41' measured of course in perpendicular directions transverse to the beam 1''.

The mold for making this structure has a guide 51' receiving top and bottom pistons 47' and 48' and rounded side pistons 49' and 50' defining a molding compartment 46'. The ends of the mold are closed by stationary end walls.

Figure 18:
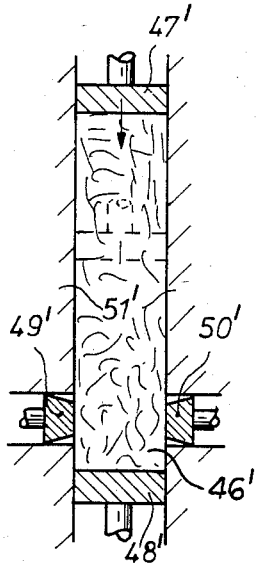
FIGS. 18–22 are small-scale cross-sectional views illustrating operation of the mold for making the member of FIG. 17.
Figure 19:
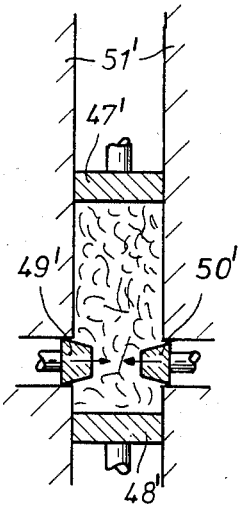

This mold is operated in five stages according to a tested example of operation according to this invention starting with a mold chamber 350 mm high and 90 mm wide:

1. The top piston 47' moves down through 150 mm as seen in FIG. 18 from the solid-line position to the dashed-line position through a long stroke to compress the mass into a rectangular-section body since the pistons 49' and 50' are wholly retracted out from between the pistons 47' and 48'.

2. The side pistons 49' and 50' then move two-thirds of their respective full strokes, here each through 20 mm, into the compartment 46' while the pressure in the cylinders for the pistons 47' and 48' is relieved to hold same stationary. This preforms the web 42'.

Figure 20:
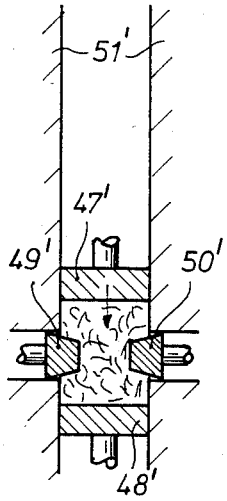

3. The top piston 47' is then moved down through 90 mm as shown in FIG. 20 while the pistons 49' and 50' are held in their intermediate positions, further vertically compacting the particle/binder mass.

Figure 21:
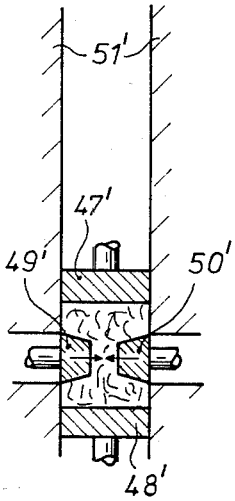

4. The pistons 49' and 50 are then as shown in FIG. 21 moved fully in, each through 10 mm more, so the distance between their confronting faces is equal to the final horizontal width of the web 42' which here is 30 mm. This movement forms compacted rounded corner regions 55 between the flanges 41' and web 42' that makes the member greatly resistant to breaking at this region.

Figure 22:
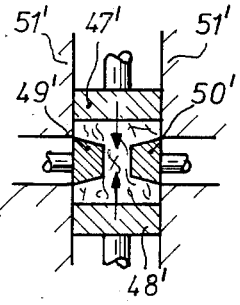

5. Finally as seen in FIG. 22 the top and bottom pistons 47' and 48' are pressed together so they each move through 10 mm to impart the final height to the beam 1''. The mold is meanwhile heated to activate and harden the binder. The resultant I-beam has a height and width of 90 mm and a web thickness of 30 mm.

Normally such a structural element 1'' is used upside down, that is so that the arcuately arranged fibers and particles are concave away from the loading direction 45'. As a result these particles effectively form interior arches in the member which increase its strength enormously. As mentioned above the procedure of moving the one piston through a much greater stroke than the other creates these internal arches since the outer fibers are impeded in moving down by friction against the mold sides whereas the inner fibers can move more freely.

Obviously these procedures could equally well be applied to structural elements serving functions different from pallet cleats, and could be applied to such members of other than I-section, as for example T- or Z-section.

I claim:

1. In a method of making an elongated press-molded structural member of substantial strength from a mass of cellulosic particles of various lengths admixed with a binder, with the structural member being set into its final hardened state by the application of heat upon completion of the pressing operation; the improvement comprising that, sequentially:

(a) a mass of the particles and binder is randomly filled into a horizontally elongated compartment defined by a pair of elongated and horizontally confronting side walls each having at least a respective portion thereof arranged for horizontal movement toward and away from the corresponding portion of the opposed side wall, an elongated top wall, and an elongated bottom wall confronting the top wall and extending generally parallel to the top and side walls, said top and bottom walls being arranged for vertical movement toward and away from each other, and all said walls during the filling operation being disposed in respective retracted starting positions with reference to the mid-region of the compartment;

(b) the top wall is displaced vertically downwardly toward the bottom wall, and the bottom wall is displaced vertically upwardly toward the top wall, into respective predetermined intermediate positions while the side walls remain stationary in their starting positions, the displacement of the top wall being many times greater than the displacement of the bottom wall so that the mass of particles in the compartment is vertically pre-compressed into the form of an oversized version of the structural member being made and so as to cause the particles engaging the top and bottom walls of the compartment to become generally parallelized with the top and bottom walls;

(c) thereafter, while said top and bottom walls remain stationary, at least said portions of the side walls are displaced horizontally toward each other between the top and bottom walls into respective inner positions so that the vertically pre-compressed mass of particles in the compartment is horizontally pre-compressed to cause lateral indentations to be formed in the side surfaces of the structural member while the particles engaging the side walls of the compartment are caused to become generally parallelized with said side walls;

(d) thereafter, while the compressive force of the side walls is maintained at its attained value and the side walls remain stationary, and prior to the application of heat, the top and bottom walls are displaced vertically toward each other into terminal positions to further vertically compress the mass of particles in the compartment into the final form of the desired structural member having the desired final dimensions; and (e) the application of heat to the compressed mass of particles in the compartment is effected without any relaxation of the compressive forces exerted on the mass by the top, side and bottom walls.

2. The method defined in claim 1 wherein the displacement of the top wall in step is at least ten times greater than the displacement of the bottom wall in step b.

3. The method defined in claim 1 wherein the displacements of the top and bottom walls in step b are effected by sequentially:

(b') downwardly displacing the top wall through a long vertical distance;

pletely fill it. Then the piston 13 is fitted in place and moved down into the position of FIG. 3, that is with its lower end surface level with the top walls of the rectangular side guides 7. Simultaneously the lower piston 10 is moved up so its upper end surface is level with the bottom walls of the rectangular side guides 7. This action aligns the fibers immediately adjacent the top surface 16 and the bottom surface 17 in layers each parallel to the respective pressing surface.

Thereafter as further shown in FIG. 3 the two side pistons 11 and 12 are moved inward so they lie generally level with the respective side walls of the lower and upper pistons 10 and 13. This action aligns the fibers immediately adjacent the side surfaces 18 in layers parallel to these side surfaces 18. The result is a first-stage cleat 19.

FIG. 4 shows how thereafter only the cores or center subpistons 15 are advanced, to form the recesses 4 in the sides 18. In this manner the surfaces of the sides are strongly compressed with the particles immediately under the surface remaining parallel thereto. These cores 15 are rounded so that some material is in the crack around them at 20, but this material is pressed out as they are advanced. The result is a second-stage workpiece 21.

Finally as shown in FIG. 5 the upper and lower pistons 13 and 10 are moved down and up respectively to further compress the element into a final or third-stage cleat 22. This action compresses the rounded corner regions 23 while further aligning the fibers of the workpiece 22 with the surfaces thereof so that the strength of the pallet cleat 1 is increased greatly. Once the mold/-press is in this position it is heated to activate and cure the normally thermosetting resin used as binder.

In this arrangement the lower piston 10 has a shape complementary to that of the lower surface 17, that is it is formed with two bumps that shape the recesses 5. This piston 10 could also be formed of a main part that shapes the bottoms of the feet 2 and two other parts that can advance to shape the recesses 5. It is also possible to form the upper and lower pistons 13 and 10 of two parts like the side pistons 11 and 12 to form recesses like the recesses 4 in the upper and lower surfaces 16 and 17 of the pallet cleat 1.

FIGS. 6–10 show the manufacture of a one-piece pallet 24 formed entirely of elongated cellulosic particles, normally wood or plant chips and fibers, and a thermosetting binder, normally a phenol-based one. As described above, the pallet has feet 2 separated by regions 3 and is formed with outwardly open hollows 4 when complete.

The mold has a single flat upper piston 25 that simultaneously presses the entire upper pallet surface and a lower piston formed by nine foot pistons 26 forming the floors of foot-forming recesses in a main piston 27 extending up well past these pistons 26. In addition the sides 33 of the mold are provided with pistons 28 that can move horizontally, that is perpendicular to the pistons 25–27. A set of such pistons 28 is provided working at a right angle to the illustrated ones, perpendicular to the plane of the view. All of the pistons 25–28 are profiled somewhat on their inner faces to form ribs, corrugations, or grooves on the respective surface of the pallet 24.

To start with the elongated particles and binder are filled into the upwardly open mold whose pistons 26–28 are in the position of FIG. 6, but whose piston 25 is raised to allow a large quantity of the bulk material to be loaded in. Then the piston 25 is moved down as indicated in FIGS. 6 and 9 in direction 36 through a distance D to a level indicated at 29 while the pistons 26 are moved up through a distance d equal to at most D/10 to a level indicated at 30.

Figure 7:
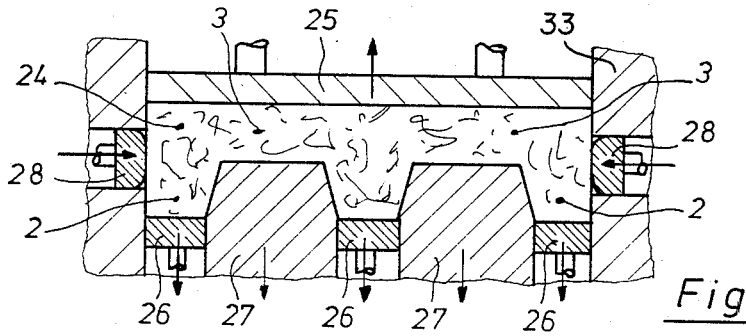
FIGS. 7 and 8 are views like FIG. 6 showing second and third steps of operation of the mold of FIG. 6.

FIG. 7 shows how then the pistons 28 are moved in to form the recesses 4 in all four outer sides of the pallet 24. During this action the pressure in the normally pneumatic cylinders that displace the pistons 25–28 is relieved somewhat as indicated by the arrows, but not enough to let the respective pistons move back.

Figure 8:
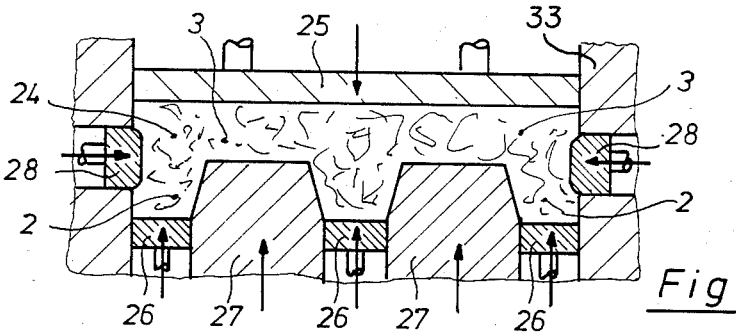

Finally as shown in FIGS. 8 and 9 the upper piston 25 moves down through the distance d to the position 31 and the lower pistons 26 and 27 move up to the positions shown at 32 through the distance d. At the same time pressure is maintained on the pistons 28.

Such an arrangement, with a disproportionately long stroke for the upper piston 25, ensures that, as shown in FIG. 10, the particles 34 adjacent the top surface of the pallet will be extremely well aligned parallel to it in layers giving the pallet great strength and making it very hard and smooth on this critical top surface. The other particles 34 just underneath the outer surfaces of the cleat body will still be well arrayed parallel to the respective surfaces as indicated in the drawing, and the interior particles 35 will lie generally on lines that are upwardly concave, since the outermost fibers will be more subject to friction with the mold side walls than the more central ones.

It would also of course be possible to operate this mold upside down, to achieve downward concavity rather than upward concavity of the lines on which the interior fibers 35 lie.

Figure 11:
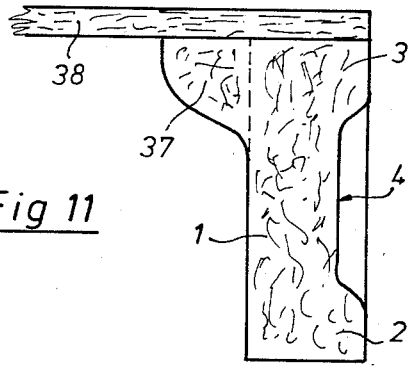
FIG. 11 is a cross section through a detail of another pallet according to the present invention.
Figure 12:
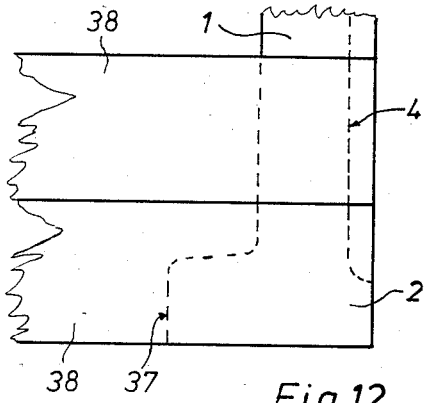
FIG. 12 is a top view of the detail shown in FIG. 11.

FIGS. 11 and 12 show a pallet having a rib or cleat 1 as in FIG. 1 secured underneath a plurality of planks 38. Here the cleat 1 is formed with a recess 4 only on its outer face, and is formed at each foot 2 with an inwardly projecting lug 37 whose upper face lies coplanar with the top surface of the cleat part 3. These lugs 37 greatly stabilize the construction.

Figure 13:
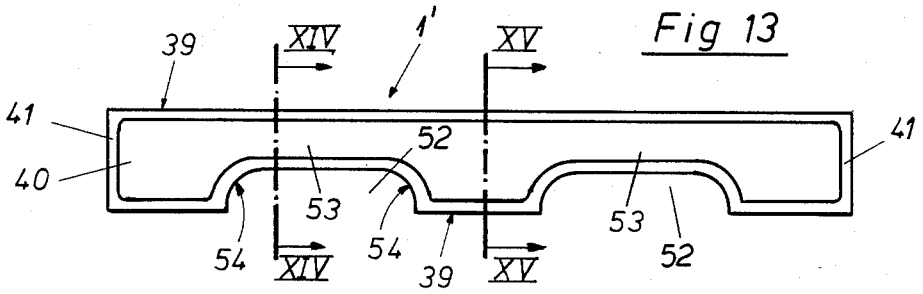
FIG. 13 is a side view of another pallet cleat according to this invention.
Figure 16:
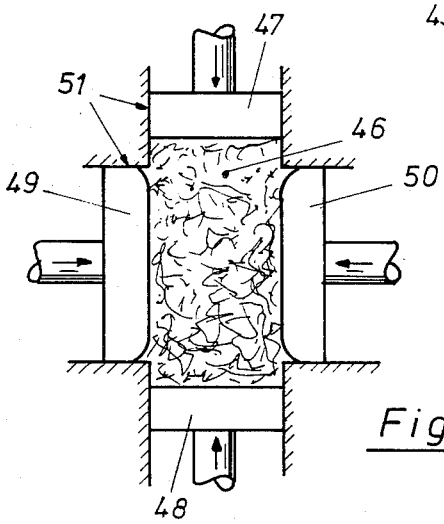
FIG. 16 is a cross section through the mold for making the pallet cleat of FIGS. 13–15.

FIGS. 13–15 illustrate a pallet cleat 1' quite similar to that of FIG. 1, and FIG. 16 shows the mold for making it. This cleat 1' is elongated and has a planar upper face 39 and three downwardly projecting equispaced feet 40 separated by notches 52. These feet 40 join intermediate parts 53 of the cleat 1' at corners 54 that are rounded for strength and to avoid cracking at this region. Longitudinal side surfaces of the cleat 1' are formed with recesses 42 that define a rim 41 extending wholly around the cleat 1' and giving it an I-beam section as seen in FIGS. 14 and 15.

The mold for making this structure has a guide 51 receiving top and bottom pistons 47 and 48 and rounded side pistons 49 and 50 defining a molding compartment 46. The ends of the mold are closed by stationary end walls. As described above the mold is closed in three stages, with the top piston 47 moving down through a long stroke while the bottom piston 48 moves up through a short stroke in the first stage, the side pistons 49 moving in while the pistons 47 and 48 are stationary in a second stage, and the pistons 47 and 48 moving vertically toward each other in short strokes in the third stage.

The result is a workpiece wherein the fibers or particles immediately adjacent the top and bottom surfaces 39 and 43 of the pallet cleat 1' are compacted lying parallel to the surfaces 39 and 43, and the particles 44 inside the body of the I-section cleat 1' lying on down- (b″) upwardly displacing the bottom wall through a short vertical distance; and (b‴) simultaneously displacing the top and bottom walls toward each other through respective short vertical distances.

4. The method defined in claim 3 wherein the mass of particles in the compartment is compressed so that in step b′ the volume is reduced by about twice as much as in step b″ in which the volume in turn is reduced by at least twice as much as in step b‴.

5. The method defined in claim 4 wherein about 60% of the total compression is effected in step b′, about 35% in step b″, and about 5% in step b‴.

6. The method defined in claim 1 wherein each side wall includes a central portion and a surrounding portion and the displacements of the side walls in step c are effected by sequentially:

(c′) initially displacing the entire side walls as units horizontally toward each other; and (c″) thereafter displacing only the central portions of the side walls toward each other.

7. The method defined in claim 6 wherein during the displacements of the top and bottom walls in step d the top and bottom walls enter into respective parts of the space between the surrounding portions of the side walls but not into any part of the space between the central portions of the side walls.

8. The method defined in claim 1 wherein the compression stages of steps b and c include, in sequence, a first displacement of the top and bottom walls followed by a first displacement of the side walls, in each case over a first part of the available total displacement, and then, in the same sequence, a second displacement of the top and bottom walls over a second part of the available total displacement thereof followed by a second displacement of the side walls over a second part of the available total displacement thereof, all prior to the final displacement of the top and bottom walls in step d and prior to the application of heat.

9. The method defined in claim 8 wherein the first and second displacements of said side walls are predetermined to effect approximately two thirds of the desired degree of compression of the mass of particles during the first displacement and approximately one third of the desired degree of compression during the second displacement.

10. The method defined in claim 8 wherein the compressive force of the top and bottom walls is relaxed at the end of each displacement thereof and prior to the respective displacements of the side walls.

* * * * *